United States Patent [19]

Smedley et al.

[11] 4,408,651

[45] Oct. 11, 1983

[54] HOT CHAMBER DIE-CASTING

[75] Inventors: Dennis Smedley, Walsall; Noel C. Spare, Nauton Beauchamp, nr. Pershore, both of England

[73] Assignee: Promagco Limited, Staffordshire, England

[21] Appl. No.: 126,352

[22] Filed: Mar. 3, 1980

[30] Foreign Application Priority Data

Mar. 21, 1979 [GB] United Kingdom ..... 7909934

[51] Int. Cl.[3] ..... B22D 17/04

[52] U.S. Cl. ..... 164/316; 164/259; 164/335

[58] Field of Search ..... 164/113, 119, 120, 133–136, 164/316–318, 309–315, 259, 335

[56] References Cited

U.S. PATENT DOCUMENTS

| | | | |
|---|---|---|---|
| 645,438 | 3/1900 | Thompson | 164/316 |
| 1,532,639 | 4/1925 | Sondley | 164/316 |
| 2,660,769 | 12/1953 | Bennett | 164/156 |
| 3,727,675 | 4/1973 | Bennett | 164/316 |
| 4,091,970 | 5/1978 | Komiyama et al. | 164/316 |

FOREIGN PATENT DOCUMENTS

| | | | |
|---|---|---|---|
| 1083025 | 6/1960 | Fed. Rep. of Germany . | |
| 900842 | 7/1945 | France | 164/318 |
| 6512327 | 3/1966 | Netherlands | 164/318 |
| 1424543 | 2/1976 | United Kingdom | 164/133 |

*Primary Examiner*—R. L. Spruill
*Assistant Examiner*—K. Y. Lin
*Attorney, Agent, or Firm*—Sigalos & Levine

[57] ABSTRACT

A gooseneck assembly (10) for hot chamber die-casting comprises a shot cylinder (12), an injection duct (16) leading from the bottom of the cylinder to a die (18), and a reservoir (20) which communicates with the shot cylinder through openings (22, 23 and 24) in a partition wall (21). The upper ends of the shot cylinder and reservoir are closed and a protective atmosphere is maintained above a level (6A) of molten metal in the assembly. The assembly is automatically recharged with molten metal from a separate crucible (3) through a syphon pipe (30).

3 Claims, 2 Drawing Figures

HOT CHAMBER DIE-CASTING

The invention relates to hot chamber die-casting of metals and metal alloys, such as magnesium based alloys. "Hot chamber" die-casting involves providing a continuous supply of hot metal at an inlet to a shot cylinder which is operated intermittently to inject a single shot of molten metal into a die. The shot cylinder and duct from the shot cylinder to a nozzle and thence to a die are contained in a "gooseneck" so called because of its "S" shape.

Previously, when hot chamber die-casting with magnesium or zinc based alloys, the gooseneck has been maintained at the injection temperature by immersing it bodily in a crucible of molten metal to which solid ingots are added at intervals to replenish the metal cast. The crucible is heated in a furnace by electricity or gas. In the case of magnesium alloys a lid is provided above the metal in order to maintain an oxidation inhibiting atmosphere above the molten metal surface. A door is provided in the lid through which metal ingots can be inserted. The lid also has to be contoured to provide a seal around the gooseneck where it leaves the furnace to join its supports in the frame of the die-casting machine.

This arrangement is inconvenient in that the immersed part of the gooseneck occupies a significant volume of the crucible so that the crucible has to be larger, heavier and more expensively constructed than if it were to provide purely a melting function for an equivalent volume of metal. As it is the heat conducted through the crucible wall has to provide a melting function, and a heat replacement function to replace heat lost through the gooseneck by conduction into the die-casting machine frame where it is supported and by radiation where it leaves the metal surface. In other words the gooseneck acts as a large heat sink.

It is anticipated that when large magnesium die-castings are required to be produced in hot chamber machines, furnace construction will have to increase in size proportionately. This will have the effect of increasing the distance between the gooseneck and the fixed half of the die thus necessitating an increase in nozzle length. This would have the effect of both increasing the incidence of distortion in the nozzle (due to thermal creep, since it has to be held at a temperature of between 600° C. and 700° C. and clamped under pressure between the gooseneck and fixed die half) and reducing the shot efficiency, i.e. the amount of metal displaced by the injection piston which is available to produce a casting, metal filling the nozzle duct having to flow back into the shot cylinder between shots.

A further disadvantage of the conventional hot chamber machine is that the temperature of the molten metal in the crucible varies due to the intermittent addition of solid ingots and this can produce variations in the quality of castings produced.

Recently there has been a significant increase in the demand for lightweight metal die-castings particularly for use in the automotive industry and magnesium die-castings have been produced using a hot chamber method similar to that previously used for making zinc die-castings. However this has produced its own problems. In the first place magnesium readily oxidises and, in spite of the protective atmosphere the molten metal is continuously subject to both oxidation at the surface (usually increased by turbulence i.e. when adding ingots) and the inevitable addition of oxide skins derived from the ingot surface. The oxide precipitates only slowly to the bottom of the crucible and will inevitably be drawn into the shot cylinder in the gooseneck.

This will have an undesirable effect on the quality of castings produced. In time a layer of considerable depth will build up on the bottom of the crucible and since magnesium oxide is an excellent insulator, the melting efficiency of the furnace will be impaired and in extreme cases, where external heating is used, critical overheating of the crucible wall will occur. It is vital therefore that this oxide be removed at regular intervals and this presents difficulties with conventional hot chamber machines in view of the obstruction caused by the gooseneck which causes problems in cleaning the crucible around and under this obstruction.

A further disadvantage of the conventional hot chamber method is that in order to facilitate servicing, the gooseneck must periodically be removed from the crucible and, because of the inflammable nature of molten unprotected magnesium, the operation, consisting of either lifting the gooseneck from the furnace or, lowering the furnace from the gooseneck, is time-consuming and hazardous.

With the increasing interest in magnesium die-castings it is probable in future that new alloys will be developed and that die-casters will have to offer castings in a range of alloys. If this becomes so the aforementioned operation will not only have to take place to permit servicing but also when a change of alloy is required especially if differing alloy systems are required and "dilution" is not acceptable.

It has been suggested in British patent specification No. 1,424,543 to refine scrap magnesium by melting the magnesium in a melting vessel which is juxtaposed with a holding vessel into which the molten magnesium flows through a filtering opening. The molten magnesium is then pumped out of the holding vessel for casting. Although this arrangement has the benefit that molten magnesium is produced at a location remote from the casting, and the molten metal is filtered to reduce the presence of sedimentary oxides at the casting step, there is no indication as to how the disclosure is applicable to hot chamber die-casting, and particularly the other problems associated with the use of a conventional gooseneck.

In accordance with the present invention a gooseneck assembly for hot chamber die-casting comprises a shot cylinder with an upright axis, an injection duct leading from the bottom of the cylinder upwards alongside the cylinder and thence into a substantially horizontal nozzle providing a connection to a die, a reservoir which is closed from the atmosphere and is positioned side by side with the shot cylinder and separated from the shot cylinder by an upright partition wall through which at least one interconnecting passageway is formed for recharging the shot cylinder with molten metal from the reservoir, and means for permitting the passage of molten metal into the reservoir in use from a separate source of molten metal.

With this arrangement the gooseneck assembly can be connected to a separate crucible in which the melting of ingots takes place and which may be a simple standard steel pressing. The gooseneck assembly can then be maintained at a constant temperature. The provision of the reservoir within the gooseneck assembly further separates the shot cylinder from the crucible and enables a small quantity of molten metal, sufficient perhaps for only two or three die-casting shots, to be provided immediately adjacent to the shot cylinder. This enables the gooseneck assembly to be made smaller and more compact than was possible with a conventional assembly. The reduction in size and weight simplifies the servicing and replacement of the gooseneck assembly and reduces the problems of thermal distortion of the nozzle, even when large die-castings are produced. The small quantity of molten metal associated with the gooseneck assembly also facilitates the change over from one die-casting alloy to another. All that is necessary is to connect a supply conduit to a different melting crucible and recommence normal operation. A maximum of perhaps twenty shots would then be all that is necessary to remove "diluted" alloy.

The means for permitting the passage of molten metal into the reservoir may be a duct leading down into the reservoir and arranged to provide in use the end of a syphon supply conduit from the separate source of molten metal. Thus the duct may be a downwardly projecting limb of a pipe which leads to the gooseneck assembly from the melting crucible. The duct may be carried by an inlet manifold which closes the top of the reservoir so that when the inlet manifold is lifted off to open the top of the reservoir, perhaps for cleaning out any sediment from the sump at the bottom of the reservoir, the duct is lifted out with the manifold.

An inlet conduit for supplying a protective atmosphere to within the upper part of the reservoir may pass through the inlet manifold. Since new metal ingots are added to the separate melting crucible, there is no need to open the reservoir to atmosphere during normal working so that oxide contaminants should not be produced within the gooseneck assembly. Any oxide which may be carried along the supply conduit from the melting crucible, and this can be minimized by filtering the supply, will then be precipitated into the sump at the bottom of the reservoir from which it may readily be removed after removing the inlet manifold at the upper end of the reservoir. As the reservoir is side by side with the shot cylinder, and may have generally smooth upright or downwardly and inwardly inclined walls, rather than being positioned around and beneath the shot cylinder as with a conventional gooseneck, emptying of the sump can be carried out without regard for any obstruction.

The top of the shot cylinder is preferably also closed from the atmosphere and one of the passageways interconnects the upper part of the reservoir with an upper part of the shot cylinder whereby a common protective atmosphere exists above the level of molten metal in the reservoir and shot cylinder. This protective atmosphere is maintained at a pressure slightly above the external atmospheric pressure to compensate for any inevitable leaks particularly at the top of the shot cylinder around the piston rod.

The shot cylinder will usually contain a piston which is moved downwards to make a working injection stroke, and in that case one of the passageways may be positioned adjacent to but below the piston at the commencement of the working stroke. This ensures that when the piston has been withdrawn molten metal can flow freely from the reservoir into the shot cylinder to recharge the cylinder but that the passageway will be as high as possible above any sediment in the bottom of the reservoir.

A third one of the passageways may be provided above the piston at the commencement of the working stroke but below the normal level of molten metal in the reservoir whereby the shot cylinder in use contains molten metal to the same level as that in the reservoir. This avoids undue pressure difference in the reservoir and shot cylinder which might obstruct the smooth operation of the piston.

The gooseneck assembly may, like the melting crucible, be heated in conventional fashion, for example by gas/air burners. Preferably however the reservoir and shot cylinder are provided within a fabricated block which is in turn surrounded by a furnace consisting of a shell containing electrical resistance or induction heating elements.

The invention also includes a die-casting plant comprising a melting crucible in which a molten body of metal to be cast may be produced and maintained; and a pipe leading from the crucible to a separate gooseneck assembly according to the primary feature of the invention whereby in use the molten metal may be fed as required along the pipe to recharge the reservoir of the assembly. The pipe preferably provides a syphon connection between the crucible and the reservoir of the gooseneck assembly so that the level of molten metal in the assembly is maintained substantially the same as that within the crucible and the supply of molten metal from the crucible to the reservoir and hence to the shot cylinder is automatic.

It will be appreciated that, in the context of the present invention, the term "gooseneck" is not to be constructed as meaning "in the shape of a gooseneck" as may have been the case previously, but merely an arrangement with a similar function and providing a duct for the molten metal to be injected from the bottom of the shot cylinder, upwards along side the cylinder and laterally to a die.

An example of a die-casting plant incorporating a gooseneck assembly constructed in accordance with the present invention is illustrated in the accompanying drawings, in which.

Figure 1:
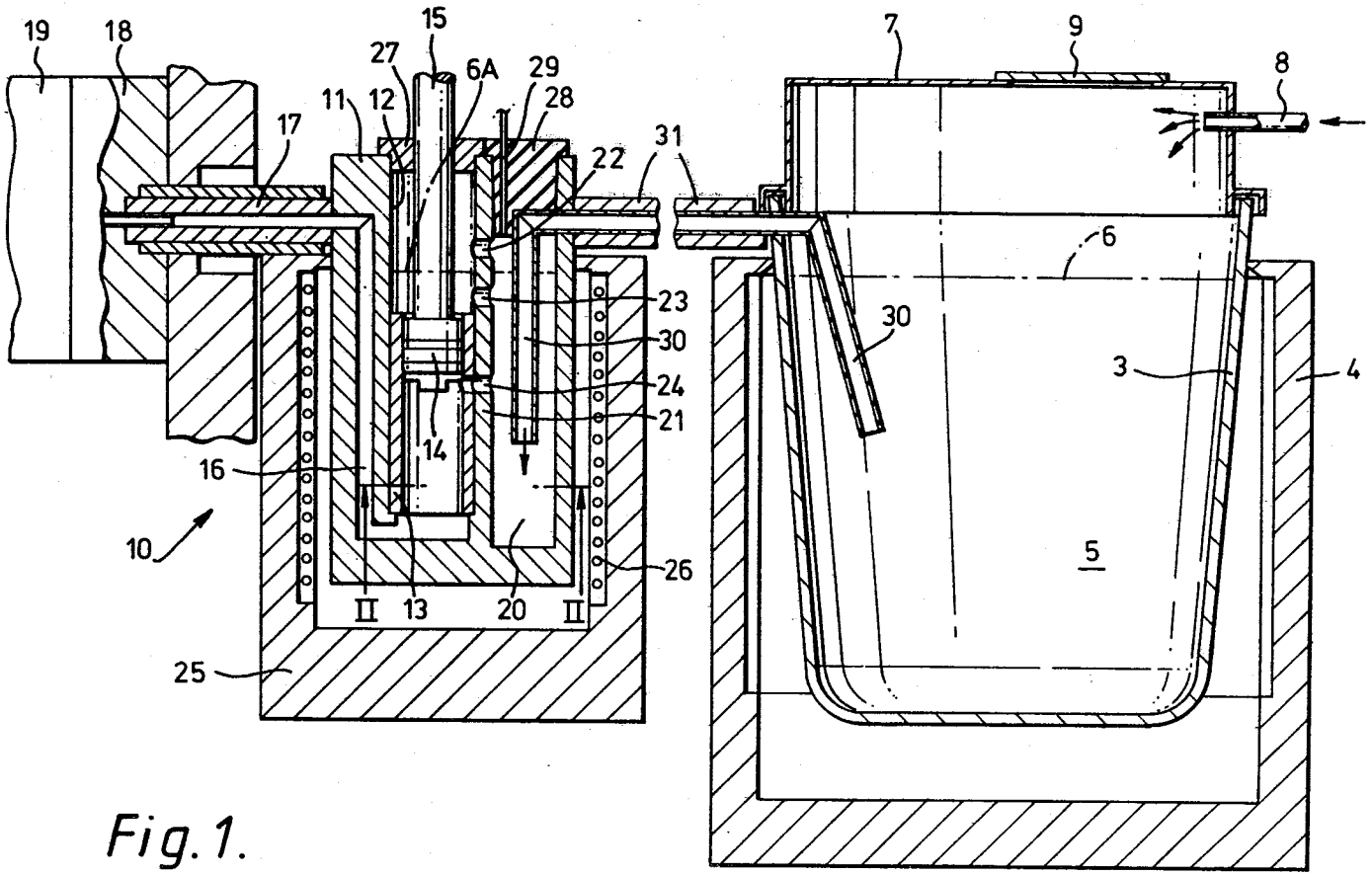
FIG. 1 is a diagrammatic central vertical cross section through the plant.

The illustrated plant comprises a pressed steel melting crucible 3 supported in a furnace 4 providing an insulating casing in which the crucible is heated electrically. The crucible is shown containing molten magnesium alloy 5 up to a level 6. The crucible 3 is covered with a lid 7 to prevent the escape of a protective atmosphere which is supplied into the space above the molten metal 5 through a conduit 8. The lid 7 incorporates a cover 9 which can be removed when it is necessary to replenish the crucible with fresh metal ingots.

At a similar level to the crucible 3 is a gooseneck assembly 10 comprising a fabricated steel block 11 containing a shot cylinder 12 having a sleeve liner 13 in which a piston 14 works. The piston 14 is connected to the bottom of a piston rod 15 which will be reciprocated from above by means of a pneumatic or hydraulic ram. The bottom of the shot cylinder 12 is connected via an injection duct 16 to a nozzle 17 clamped between the block 11 and a fixed die half 18 cooperating with a movable die half 19.

Figure 2:
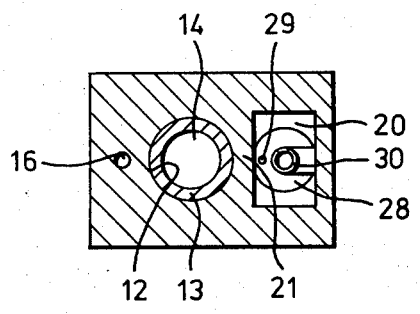
FIG. 2 is a section taken on the line II-II in FIG. 1.

The block 11 also includes a reservoir 20 having parallel side walls and of rectangular section. As shown in FIG. 2 one side wall 21 of the reservoir acts as a partition wall separating the reservoir from the shot cylinder 12 and is provided with three passageways 22, 23, and 24 interconnecting the reservoir 20 and shot cylinder 12.

The block 11 is surrounded by a furnace 25 consisting of a steel shell lined with refractory bricks and providing a space 26 containing electrical resistance heating elements.

The top of the shot cylinder 12 is substantially sealed by a gland 27 and the top of the reservoir 20 is substantially sealed by an inlet manifold 28 provided with an inlet conduit 29 for supplying a protective gaseous atmosphere in the upper part of the reservoir 20 and, via the passageway 22, in the upper part of the shot cylinder.

The gooseneck assembly is connected to the melting crucible by means of a syphon pipe 30 an inlet end of which extends down below the level 6 into the body of molten metal 5 in the crucible 3 and the outlet end of which extends downwards into the reservoir 20 just below the level of the passageway 24. Between the crucible 3 and the gooseneck assembly 10, the pipe 30 is surrounded by an insulating sleeve 31, which may be heated externally, for example by gas burners. Once the system has been primed, the syphon pipe 30 ensures that the reservoir 20 of the gooseneck assembly 10 is maintained up to the level 6A, which corresponds with the level 6, with molten metal. The presence of the passageway 23 ensures that the same level of molten metal exist in the shot cylinder 12. The passageway 24 ensures that when the piston 14 is in its retracted raised position, the bottom of the shot cylinder 12 is also flooded with molten metal.

In operation the piston 14 is forced downwards to inject molten metal through the duct 16 and nozzle 17 into the die, and then makes an idle return stroke to the illustrated position for recharging of the shot cylinder from the reservoir. The syphon pipe 30 automatically keeps the gooseneck assembly replenished from the crucible.

Any oxide sedimenting in the sump formed by the bottom of the reservoir 20 can readily be removed after removal of the inlet manifold 28 and associated pipe work. In this respect at least the limb of the pipe 30 passing through the inlet manifold 29 and down into the reservoir 20 may be removable up out of the reservoir 20 together with the inlet manifold 28. The illustrated plant is suitable for die-casting of all magnesium based die-casting alloys. When the casting alloy is to be changed, it is only necessary to connect the syphon pipe 30 from the gooseneck assembly to a new crucible and then to operate the gooseneck assembly until the assembly has been purged of the first alloy.

We claim:

1. A gooseneck assembly for hot chamber die-casting, said assembly comprising a shot cylinder with an upright axis, an injection duct leading in a direction from the bottom of said cylinder upward along a side of said cylinder to a substantially horizontal nozzle which extends in a direction away from said cylinder and which is provided with a connection to a die, a separate reservoir of molten metal which is closed from the atmosphere by a closure member which is removable from the top of said reservoir independently of said cylinder whereby said reservoir can be serviced without removing said cylinder, means connecting said reservoir to the interior of said cylinder, means for supplying molten metal to the interior of said reservoir from a separate source of molten metal, means for maintaining a common protective atmosphere in the top of said reservoir and in the top of said cylinder, a piston which is movable downwardly in said cylinder from an upper to a lower position to perform a working stroke and to displace a shot of said molten metal out of said cylinder through said injection duct and nozzle into said die, and means for moving said piston between said upper and lower positions wherein said cylinder and said reservoir are formed as an integral unit with a common bottom wall and with said reservoir positioned only at one side of said cylinder remote from said injection duct, said cylinder interior and said reservoir interior being separated by a partition wall which extends upwards from said bottom wall and which is provided with a first passageway interconnecting said reservoir interior and said cylinder interior at a position spaced above the bottom of said reservoir and adjacent to but below said piston when in said upper position, a second passageway in said partition wall interconnecting said reservoir interior and said cylinder interior at a position spaced below the top of said reservoir and above said piston when in said upper position.

2. A gooseneck assembly as in claim 1 further including means for supplying said metal to said reservoir by means of a syphon pipe leading from a melting crucible.

3. A gooseneck assembly as in claim 2 further including a common protective atmosphere supplying pipe through said reservoir closure and a third passageway through said partition wall above said second passageway.

* * * * *